US011281152B1

(12) United States Patent
Kokubu

(10) Patent No.: US 11,281,152 B1
(45) Date of Patent: Mar. 22, 2022

(54) HOUSING AND IMAGE FORMING APPARATUS

(71) Applicant: FUJIFILM Business Innovation Corp., Tokyo (JP)

(72) Inventor: Fuyuki Kokubu, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/377,321

(22) Filed: Jul. 15, 2021

(30) Foreign Application Priority Data

Mar. 25, 2021 (JP) ..... JP2021-052466

(51) Int. Cl.
*G03G 15/00* (2006.01)
*G03G 21/16* (2006.01)

(52) U.S. Cl.
CPC ... *G03G 21/1633* (2013.01); *G03G 2221/169* (2013.01)

(58) Field of Classification Search
CPC ..... G03G 21/1633; G03G 21/1638; G03G 2221/169
See application file for complete search history.

(56) References Cited

U.S. PATENT DOCUMENTS

2015/0050042 A1* 2/2015 Sato ..... G03G 21/1842 399/110
2016/0246235 A1* 8/2016 Koyama ..... G03G 21/1604

FOREIGN PATENT DOCUMENTS

JP 2012173339 9/2012

* cited by examiner

*Primary Examiner* — Hoang X Ngo
(74) *Attorney, Agent, or Firm* — JCIPRNET

(57) ABSTRACT

A housing includes a housing main body that has an opening in one surface; a first cover that is openably and closably supported by the housing main body by means of a first rotation portion, that covers at least a portion of the opening, and that is provided with an operation portion that causes the first cover in a closed state to enter an open state, the first rotation portion being provided on a portion of the one surface that is on one side with respect to the opening in one direction; and a second cover that is openably and closably supported by the first cover and of which an operation portion that causes the second cover in a closed state to enter an open state is provided at a position that is separated from the operation portion of the first cover by at least half a distance between the operation portion of the first cover and the first rotation portion in the one direction while being on the first rotation portion side.

13 Claims, 11 Drawing Sheets

HOUSING AND IMAGE FORMING APPARATUS

CROSS-REFERENCE TO RELATED APPLICATIONS

This application is based on and claims priority under 35 USC 119 from Japanese Patent Application No. 2021-052466 filed Mar. 25, 2021.

BACKGROUND

(i) Technical Field

The present invention relates to a housing and an image forming apparatus.

(ii) Related Art

Described in JP2012-173339A is an image forming apparatus that includes an apparatus main body, a first cover that is openably and closably provided on one side surface of the apparatus main body and that covers a first region of the one side surface in a closed state, a second cover that is openably and closably provided on the one side surface of the apparatus main body and that covers a second region of the one side surface in a closed state, and a first inhibition portion that inhibits the first cover from being opened in a case where the first cover is closed and can cancel the inhibition in a state where the second cover is open.

SUMMARY

Aspects of non-limiting embodiments of the present disclosure relate to a housing and an image forming apparatus that restrain a first cover from being opened due to an operation of opening a second cover in a configuration in which one surface of a housing main body is covered by the first cover and the second cover and the first cover is supported by the housing main body by means of a first rotation portion.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a housing that includes: a housing main body that has an opening in one surface; a first cover that is openably and closably supported by the housing main body by means of a first rotation portion, that covers at least a portion of the opening, and that is provided with an operation portion that causes the first cover in a closed state to enter an open state and that is close to an end portion on the other side in the one direction, the first rotation portion being provided on a portion of the one surface that is on one side with respect to the opening in one direction; and a second cover that is openably and closably supported by the first cover and of which an operation portion that causes the second cover in a closed state to enter an open state is provided at a position that is separated from the operation portion of the first cover by at least half a distance between the operation portion of the first cover and the first rotation portion in the one direction while being on the first rotation portion side.

BRIEF DESCRIPTION OF THE DRAWINGS

Exemplary embodiment(s) of the present invention will be described in detail based on the following figures, wherein.

DETAILED DESCRIPTION

An example of a housing according to an exemplary embodiment of the present invention and an image forming apparatus including the housing will be described with reference to FIGS. 1 to 7.

Note that, in the following description, an apparatus vertical direction (height direction), an apparatus width direction (horizontal direction), and an apparatus depth direction (horizontal direction) in a front view of an image forming apparatus 20 as seen from a side on which a user (not shown) stands will be referred to as an H direction, a W direction, and a D direction, respectively. In addition, in a case where it is necessary to distinguish between one side and the other side in each of the apparatus vertical direction, the apparatus width direction, and the apparatus depth direction, an upper side, a lower side, a right side, a left side, a rear side, and a front side in the front view of the image forming apparatus 20 will be referred to as a +H side, a −H side, a +W side, a −W side, a −D side, and a +D side, respectively.

Image Forming Apparatus

Figure 2:
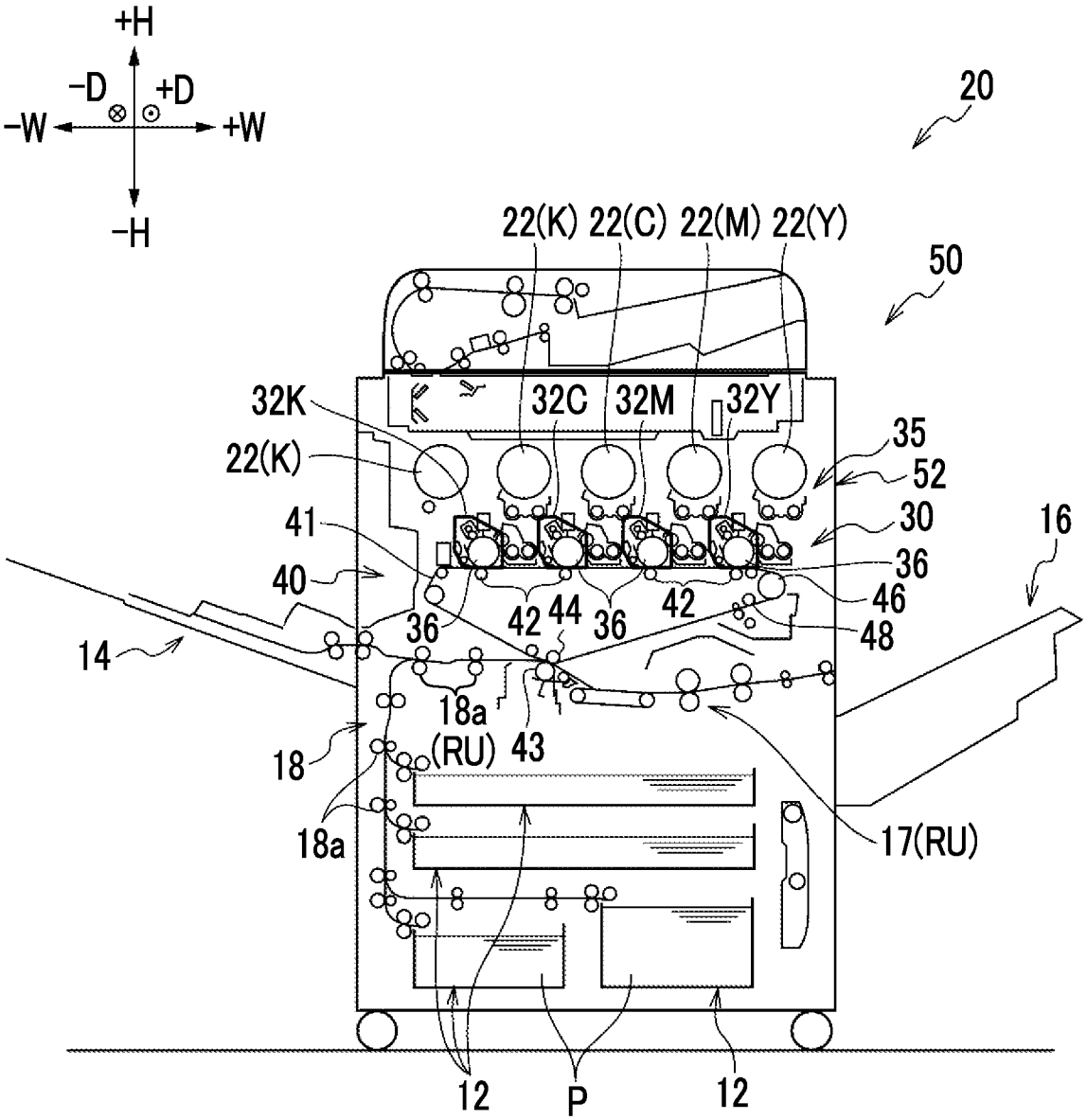
FIG. 2 is a front view showing an internal configuration of the image forming apparatus according to the exemplary embodiment.

The image forming apparatus 20 according to the present exemplary embodiment is an apparatus that forms an image on a sheet member P as a recording medium. The way in which the image forming apparatus according to the exemplary embodiment of the present invention forms an image is not particularly limited and an inkjet image forming method or an electrophotographic image forming method can be adopted, for example. In the present exemplary embodiment, an example of an electrophotographic image forming apparatus will be described as an example. As shown in FIG. 2, the image forming apparatus 20 includes a housing 50, accommodation portions 12, a medium supply portion 14, a medium discharge portion 16, a transportation unit 18, an image forming unit 30, and cartridge units 22, a fixation unit 17, and a control unit (not shown). The accommodation portions 12 are configured to include a drawable tray that is provided on a bottom side of the housing 50 and can be drawn and have a function of accommodating the sheet member P. The medium supply portion 14 is configured to include a supply port and a supply tray provided at a side surface of the housing 50 that is on the −W side and has a function of supplying the sheet member P disposed on the supply tray to the inside of the housing 50. The medium discharge portion 16 is configured to include a discharge port and a discharge tray provided at a side surface of the housing 50 that is on the +W side. The transportation unit 18 is configured to include a plurality of transportation rollers 18*a* and has a function of transporting, to the image forming unit 30 side, the sheet member P accommodated in the accommodation portions 12 or the sheet member P supplied from the medium supply portion 14. The control unit (not shown) controls the operation of each unit of the image forming apparatus 20. Note that, the details of the housing 50 will be described later.

Image Forming Unit

The image forming unit 30 is accommodated above the accommodation portions 12 in the housing 50 and is configured to include image formation units 32, a toner supply unit 35, and a transfer unit 40. In addition, the image forming unit 30 is configured to include a cover portion 34 that covers a front side of the image forming unit 30 (refer to FIG. 5). The cover portion 34 is attachably and detachably attached to the image forming unit 30. The image formation units 32 are composed of four image formation units 32Y, 32M, 32C, and 32K. Here, yellow (Y), magenta (M), cyan (C), and black (K) are examples of toner colors. The toner supply unit 35 supplies toners T of the cartridge units 22, which will be described later, to the image formation units 32.

Each of the four image formation units 32Y, 32M, 32C, and 32K includes a photosensitive drum 36. The four image formation units 32Y, 32M, 32C, and 32K form toner images on outer peripheral surfaces of the photosensitive drums 36 corresponding to respective colors by using the toners T of colors of Y, M, C, and K that are supplied from the cartridge units 22 via the toner supply unit 35. The toners T are an example of a coloring material. The four image formation units 32 are disposed in a state of being arranged in the order of yellow (Y), magenta (M), cyan (C), and black (K) from the +W side in the apparatus width direction.

The transfer unit 40 is configured to include a transfer belt 41, primary transfer rollers 42 corresponding to the four image formation units 32Y, 32M, 32C, and 32K, a secondary transfer roller 43, a backup roller 44, a driving roller 46, and a supporting roller 48.

The transfer belt 41 is an endless belt disposed below the image formation units 32. An inner peripheral surface of the transfer belt 41 is supported by the primary transfer rollers 42, the backup roller 44, the driving roller 46, and the supporting roller 48, and the transfer belt 41 and forms an inverted triangular shape as seen in a front view (as seen from front side in apparatus depth direction). The transfer belt 41 travels around counterclockwise as seen from the front side.

An outer peripheral surface of a portion of the transfer belt 41 that is supported by the primary transfer rollers 42 is in contact with the photosensitive drums 36 of the image formation units 32Y, 32M, 32C, and 32K. Toner images TZ formed on the photosensitive drums 36 are primarily transferred onto the transfer belt 41 while the transfer belt 41 is travelling around counterclockwise.

The backup roller 44 is disposed inside the transfer belt 41 while being at a lower vertex of the transfer belt 41 forming the inverted triangular shape.

The secondary transfer roller 43 is disposed to face the backup roller 44 with the transfer belt 41 interposed therebetween. The secondary transfer roller 43 secondarily transfers, onto the sheet member P transported to a position at which the sheet member P faces the backup roller 44 with the transfer belt 41 interposed therebetween, the toner images TZ primarily transferred onto the outer peripheral surface of the transfer belt 41. Furthermore, the secondary transfer roller 43 transports, to the fixation unit 17, the sheet member P onto which the toner images have been secondarily transferred.

Fixation Unit

The fixation unit 17 is disposed in a space above the accommodation portions 12 and below the image forming unit 30 in the housing 50 and is configured to include a heating roller and a pressing roller. The fixation unit 17 heats and presses the sheet member P transported from the image forming unit 30 to fix an image, to the sheet member P, an image that is transferred onto the sheet member P by the image forming unit 30. In addition, the fixation unit 17 transports the sheet member P, onto which the image has been fixed, to the medium discharge portion 16 so that the sheet member P is discharged to the discharge tray via the discharge port.

The fixation unit 17, the secondary transfer roller 43, and a portion of the transportation rollers 18*a* of the transportation unit 18 constitute a roller unit RU in the image forming apparatus 20. The roller unit RU includes a cover portion CV that covers a front side of the roller unit RU (refer to FIG. 5).

Cartridge Unit

The cartridge units 22 are composed of five cartridge units 22Y, 22M, 22C, and 22K corresponding to the toner colors. The cartridge units 22Y, 22M, 22C, and 22K are containers that contain the toners T corresponding to respective toner colors and extend in the apparatus depth direction. The cartridge units 22 are accommodated in a space above the image forming unit 30 in the housing 50 and are replaceable (refer to FIGS. 4 and 5). Specifically, the cartridge units 22 are configured such that the cartridge units 22 can be removed from the housing 50 by being pulled toward the front side (+D side) with respect to the housing 50. The five cartridge units 22 are disposed in a state of being arranged in the order of yellow (Y), magenta (M), cyan (C), and black (K) from the +W side in the apparatus width direction. Note that, in the exemplary embodiment, the number of cartridge units 22K for black (K) is two.

The cartridge units 22Y, 22M, 22C, and 22K supply the toners T to the image formation units 32Y, 32M, 32C, and 32K corresponding to the respective toner colors.

Housing

Figure 1:
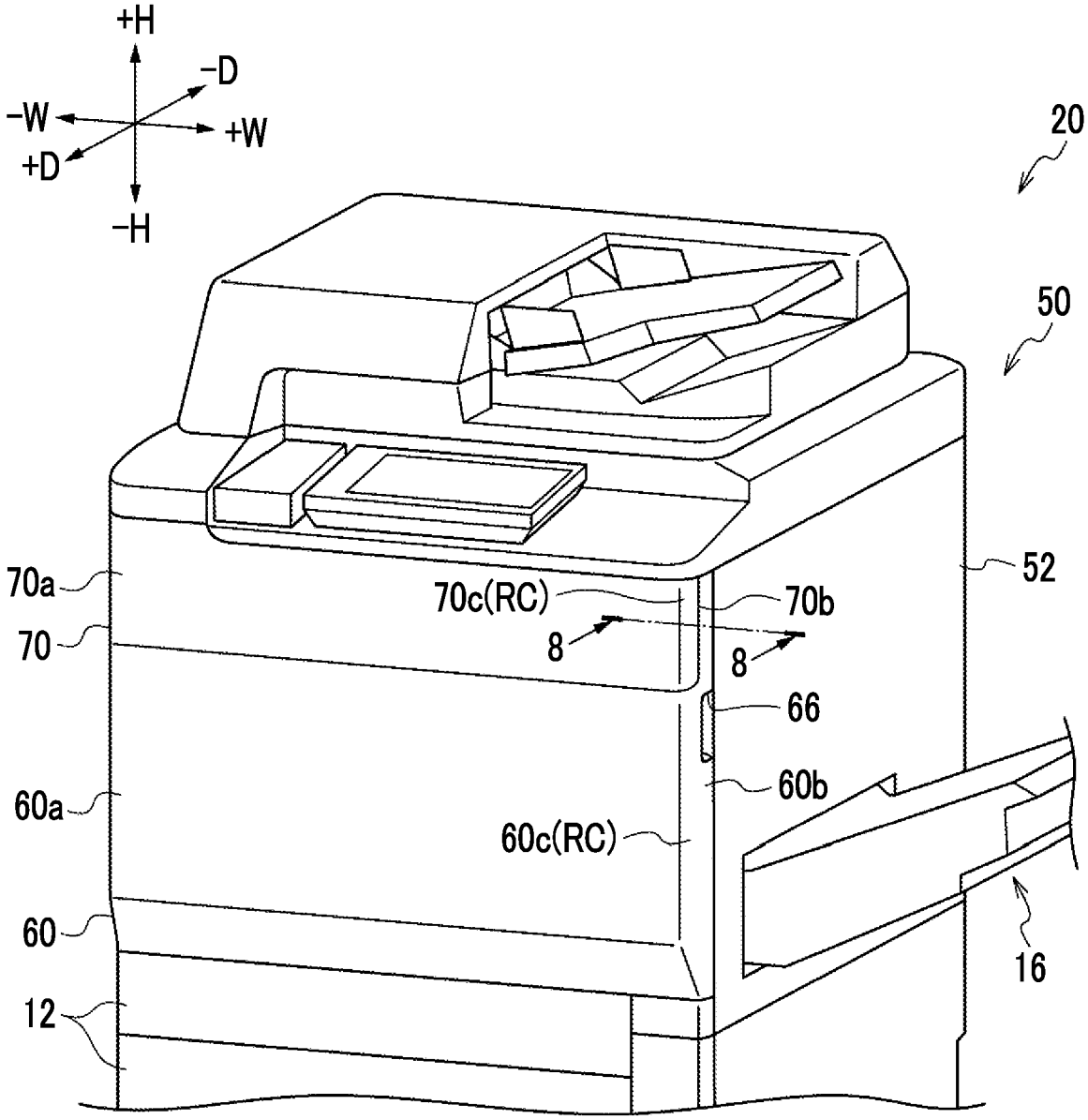
FIG. 1 is a perspective view showing an image forming apparatus according to an exemplary embodiment.
Figure 4:
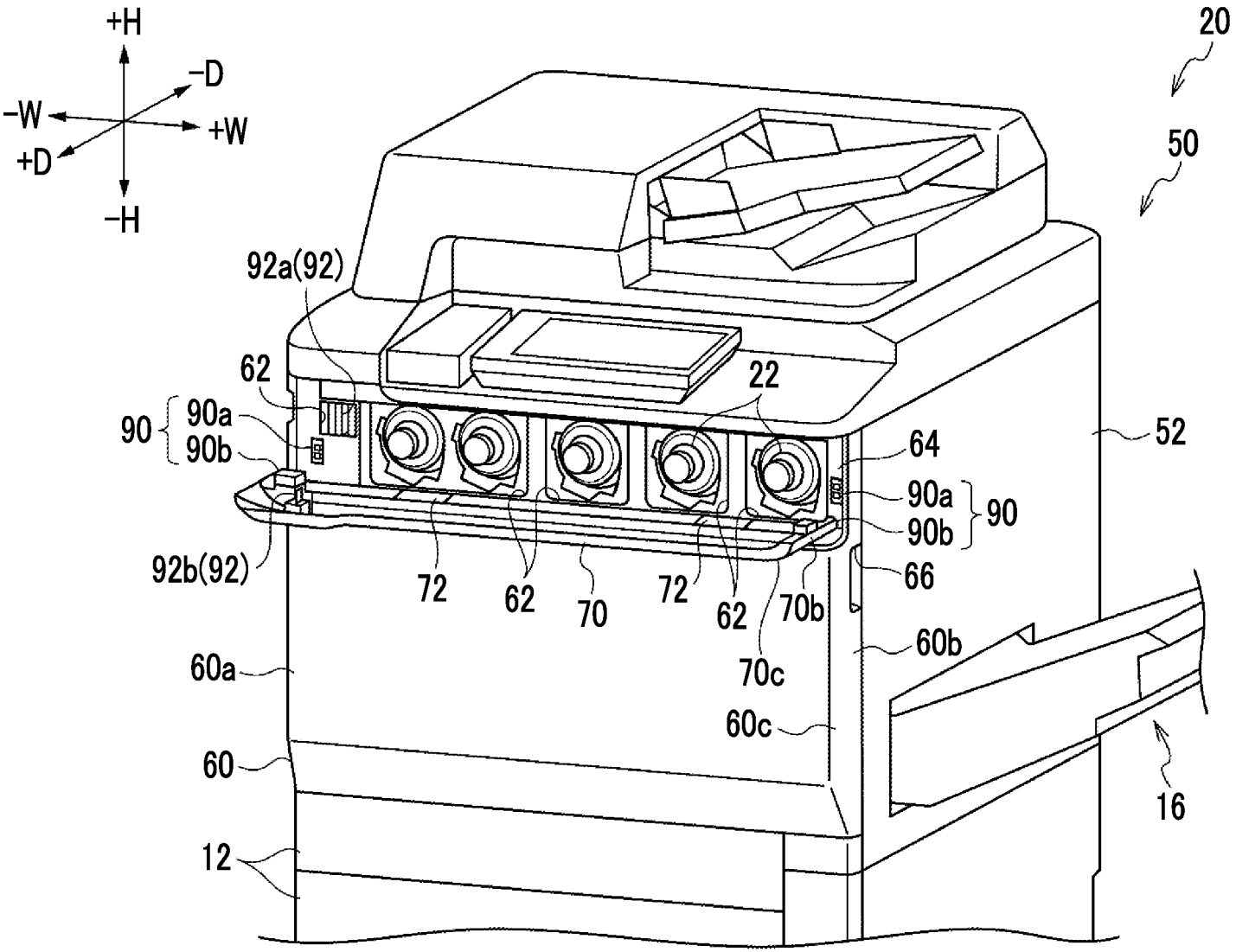
FIG. 4 is a perspective view showing the image forming apparatus according to the exemplary embodiment with a second cover opened.
Figure 5:
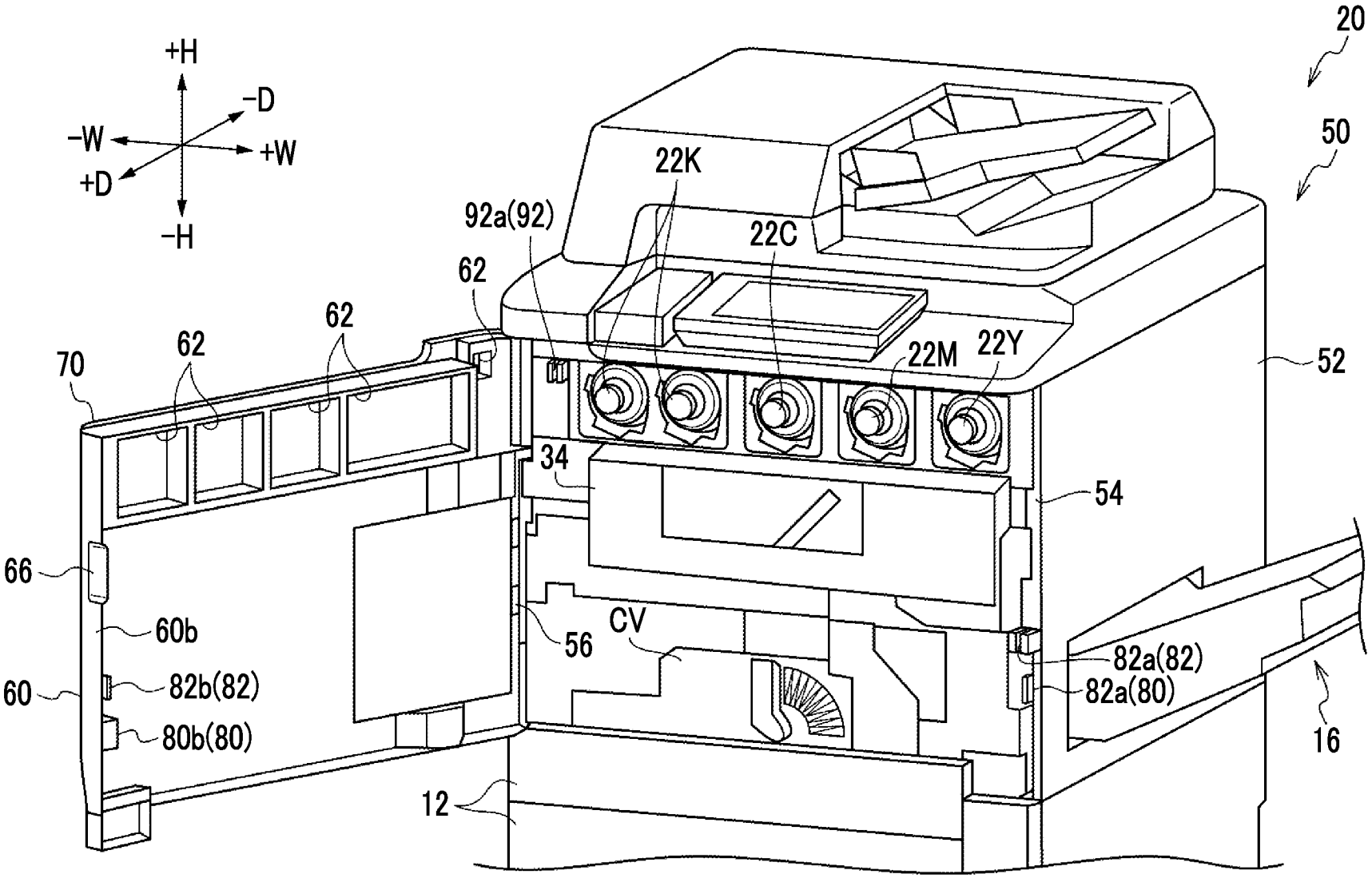
FIG. 5 is a perspective view showing the image forming apparatus according to the exemplary embodiment with a first cover opened.

As shown in FIG. 1, the housing 50 is configured to include a housing main body 52, a first cover 60, and a second cover 70. In addition, as shown in FIG. 5, the housing 50 includes a first binding unit 80 and a first switch unit 82 corresponding to the first cover 60. In addition, as shown in FIG. 4, the housing 50 includes a second binding unit 90 and a second switch unit 92 corresponding to the second cover 70.

Housing Main Body

As shown in FIG. 2, the housing main body 52 is a box-shaped structure that accommodates each part of the image forming apparatus 20. In the housing main body 52, the cartridge units 22, the image forming unit 30, the transportation unit 18, the fixation unit 17, and the accommodation portions 12 are accommodated in this order from the top. As shown in FIG. 5, a surface on the front side (+D side) of the housing main body 52 is a front surface 54. The front surface 54 is an example of one surface. The housing main body 52 has an opening in the front surface 54. The front sides (+D sides) of the cartridge units 22, the image forming unit 30, and the roller unit RU are partially exposed through the opening in the front surface 54 of the housing main body 52. The cartridge units 22 and the image forming unit 30 can be subject to maintenance through the exposed portions.

Regarding the housing main body 52, a magnet 80*a* of the first binding unit 80 is disposed at an end portion of the front surface 54 that is on the +W side, as shown in FIG. 5. In addition, regarding the housing main body 52, an opening portion 92*a* of the second switch unit 92 is disposed at an end portion of the front surface 54 that is on the −W side and overlaps with the cartridge units 22 in the apparatus vertical direction. In addition, regarding the housing main body 52, an opening portion 82*a* of the first switch unit 82 is disposed at an end portion of the front surface 54 that is on the +W side. Details of the magnet 80*a*, the opening portion 92*a*, and the opening portion 82*a* will be described later.

First Cover

As shown in FIG. 1, the first cover 60 is an approximately rectangular plate-shaped member that covers the opening of the front surface 54 of the housing main body 52. In other words, the first cover 60 covers at least a portion of an opening of the housing main body 52. As shown in FIG. 5, the first cover 60 is supported by means of a first hinge 56 such that the front surface 54 of the housing main body 52 can be opened and closed, the first hinge 56 being provided on a side wall of the housing main body 52 that is on the −W side. In other words, the first cover 60 is supported by means of the first hinge 56 that is provided on a portion on the −W side with respect to the opening in the front surface 54 of the housing main body 52. The first hinge 56 is disposed such that a shaft portion extends in the apparatus vertical direction. That is, a rotation axis (does not mean physical shaft but center of rotation of first cover 60 with respect to housing main body 52 (hereinafter, same applies to "rotation axis of first hinge 56" in this paragraph)) of the first hinge 56 extends in the apparatus vertical direction. The first cover 60 switches between a closed state shown in FIG. 1 and an open state shown in FIG. 5 by rotating around the rotation axis of the first hinge 56. The first hinge 56 is an example of a first rotation portion.

The configuration of the first hinge 56 according to the exemplary embodiment of the present invention is not particularly limited as long as the first hinge 56 can support the first cover 60 such that the front surface 54 of the housing main body 52 can be opened and closed with the first cover 60 rotating around the rotation axis. The first hinge 56 may be configured to include, for example, two plate members of which edge portions are connected to each other by a shaft portion and may be integrally formed with the first cover 60 or the housing main body 52. That is, the configuration of the first rotation portion in the present specification is not limited to a hinge-shaped member as long as the first rotation portion serves as a reference for the rotation of the first cover that is opened or closed by being rotated. In addition, a rotation axis of the first rotation portion may be a virtual axis and a configuration in which a shaft portion that is long in a rotation axis direction is not provided may also be adopted. For example, the first rotation portion may be configured to include a recess portion or a through-hole that is formed at the first cover or the housing main body along the rotation axis and a protrusion that is formed at the housing main body or the first cover and is fitted into the recess portion or the through-hole in a state of being able to rotate around the rotation axis. In addition, the position of the rotation axis of the first rotation portion may change in a case where the first cover is opened or closed.

In the exemplary embodiment, the first cover 60 is openably and closably supported by means of the first hinge 56, the first cover 60 swinging left as seen from the front surface 54 side of the housing main body 52.

Figure 3:
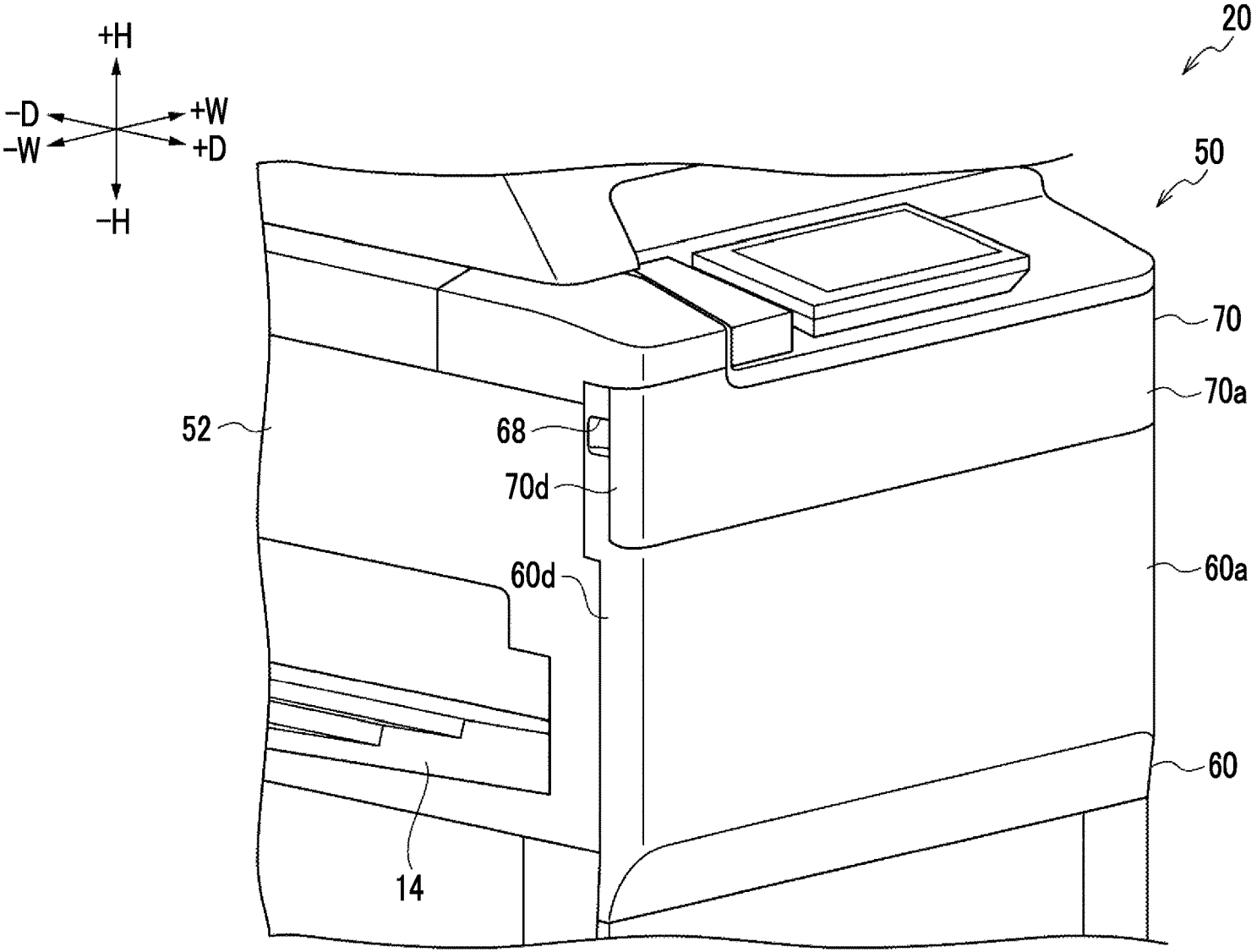
FIG. 3 is an enlarged perspective view showing a portion of the image forming apparatus according to the exemplary embodiment.

As shown in FIG. 1, the first cover 60 has a front cover 60*a* that extends along an HW plane and a side wall 60*b* that is on the +W side with respect to the front cover 60*a* and extends along a side surface of the housing main body 52 that is on the +W side in the closed state. The side wall 60*b* is an example of an end portion of the first cover 60 that is on the +W side. In the exemplary embodiment, the first cover 60 has a curved surface portion 60*c* that is formed between the front cover 60*a* and the side wall 60*b* and has a rounded shape as seen in the apparatus vertical direction. Furthermore, as shown in FIG. 3, the first cover 60 has a side wall 60*d* that is on the −W side with respect to the front cover 60*a* and extends along a side surface of the housing main body 52 that is on the −W side in the closed state. An upper portion of the front cover 60*a* is a stepped portion 64 recessed to a rear side with respect to a lower portion. The stepped portion 64 is formed at a position where the first cover 60 overlaps with the cartridge units 22 in the apparatus vertical direction. A plurality of window portions 62 corresponding to the plurality of cartridge units 22 and the opening portion 92*a* are formed in the stepped portion 64. As shown in FIG. 4, in a case where the first cover 60 is in the closed state, the cartridge units 22 and the opening portion 92*a* of the second switch unit 92, which are exposed through the opening of the front surface 54 of the housing main body 52, are exposed through the window portions 62. In addition, as shown in FIG. 1, in a case where the first cover 60 is in the closed state, the first cover 60 covers the image forming unit 30 and the roller unit RU, which are exposed through the opening of the front surface 54 of the housing main body 52, from the front side (+D side) (refer to FIG. 5). In other words, the first cover 60 covers a portion of the front surface 54 of the housing main body 52.

As shown in FIG. 1, the first cover 60 has a recess portion 66 formed at the side wall 60*b*. In other words, the recess portion 66 is provided at an end portion of the first cover 60 that is on the +W side. The distance between the recess portion 66 and the first hinge 56 in the apparatus width direction will be referred to as a distance L1. In a case where the first cover 60 in the closed state is pulled to the front side (+D side) with a finger or the like hooked on the recess portion 66, the first cover 60 is rotated around the shaft portion of the first hinge 56 and enters the open state (refer to FIG. 5). The recess portion 66 is an example of an operation portion of the first cover 60.

As shown in FIG. 4, regarding the first cover 60 in the closed state, a magnet 90*a* of the second binding unit 90 is disposed on each of both end portions of a plate surface of the stepped portion 64 in the apparatus width direction, the plate surface being on the front cover 60*a* side. In addition, as shown in FIG. 5, a magnetic block 80*b* paired with the magnet 80*a* of the first binding unit 80 is disposed at a plate surface of the first cover 60 that faces the −D side in a case where the first cover 60 is in the closed state. In addition, a protruding portion 82*b* paired with the opening portion 82*a* of the first switch unit 82 is disposed at the plate surface of the first cover 60 that faces the −D side in a case where the first cover 60 is in the closed state. Details of the magnet 90*a*, the magnetic block 80*b*, and the protruding portion 82*b* will be described later.

Second Cover

Figure 6:
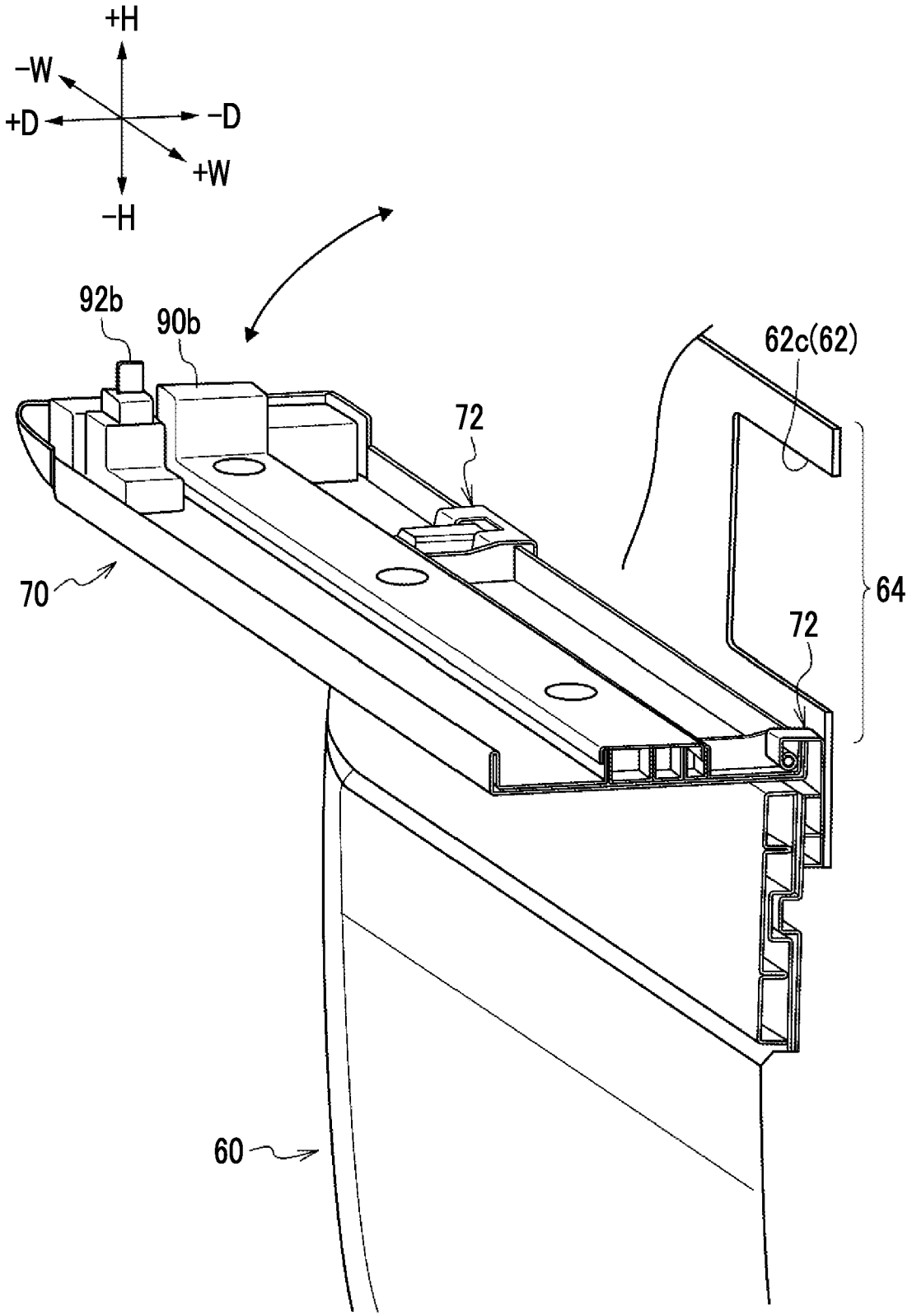
FIG. 6 is an enlarged perspective view showing a state where the second cover of the exemplary embodiment is open with portions of the first cover and the second cover shown in a cutaway manner.

As shown in FIGS. 1 and 4, the second cover 70 is an approximately rectangular plate-shaped member that covers the stepped portion 64, which is an example of a portion of the first cover 60. That is, the second cover 70 is disposed at a position adjacent to the front cover 60*a* of the first cover 60 in the apparatus vertical direction as seen from the front cover 60*a* side in a case where the first cover 60 is in the closed state. As shown in FIG. 6, the second cover 70 is supported by means of a second hinge 72 provided at the stepped portion 64 of the first cover 60 such that stepped portion 64 of the first cover 60 can be opened and closed. In other words, the second cover 70 covers a portion of the first cover 60. The second hinge 72 is disposed at a lower side of the stepped portion 64 such that a shaft portion extends in the apparatus width direction. That is, a rotation axis (does not mean physical shaft but center of rotation of second cover 70 with respect to first cover 60 (hereinafter, same applies to "rotation axis of second hinge 72" in this paragraph)) of the second hinge 72 extends in an intersection direction which is a direction intersecting the rotation axis of the first hinge 56 as seen in a front view of the first cover 60. In other words, the rotation axis of the second hinge 72 extends in the apparatus width direction. The second cover 70 switches between a closed state shown in FIG. 1 and an open state shown in FIG. 4 by rotating around the rotation axis of the second hinge 72. The second hinge 72 is an example of a second rotation portion.

The configuration of the second hinge 72 according to the exemplary embodiment of the present invention is not particularly limited as long as the second hinge 72 can support the second cover 70 such that the stepped portion 64 of the first cover 60 can be opened and closed with the second cover 70 rotating around the rotation axis. The second hinge 72 may be configured to include, for example, two plate members of which edge portions are connected to each other by a shaft portion and may be integrally formed with the second cover 70 or the first cover 60. That is, the configuration of the second rotation portion in the present specification is not limited to a hinge-shaped member as long as the second rotation portion serves as a reference for the rotation of the second cover that is opened or closed by being rotated. In addition, a rotation axis of the second rotation portion may be a virtual axis and a configuration in which a shaft portion that is long in a rotation axis direction is not provided may also be adopted. For example, the second rotation portion may be configured to include a recess portion or a through-hole that is formed at the second cover or the first cover along the rotation axis and a protrusion that is formed at the first cover or the second cover and is fitted into the recess portion or the through-hole in a state of being able to rotate around the rotation axis. In addition, the position of the rotation axis of the second rotation portion may change in a case where the second cover is opened or closed.

Since the first cover 60 is provided with the second cover 70, as shown in FIG. 5, the second cover 70 moves integrally with the first cover 60 in a case where the state of the first cover 60 changes to the open state from the closed state.

As shown in FIG. 1, the second cover 70 has a front cover 70*a* that extends along the HW plane and a side wall 70*b* that extends along the side wall 60*b* of the first cover 60 in the closed state. In the exemplary embodiment, the second cover 70 has a curved surface portion 70*c* that is formed between the front cover 70*a* and the side wall 70*b* and has a rounded shape as seen in the apparatus vertical direction. Furthermore, as shown in FIG. 3, the second cover 70 has a side wall 70*d* that extends along the side wall 60*d* of the first cover 60 in the closed state. As shown in FIG. 1, in a case where the both of the second cover 70 and first cover 60 are in the closed state, the second cover 70 covers the cartridge units 22, which are exposed through the opening of the front surface 54 of the housing main body 52 and the window portions 62 of the first cover 60, from the front side (+D side) (refer to FIG. 4). In other words, the second cover 70 covers a portion of the front surface 54 of the housing main body 52. As shown in FIG. 3, a portion of the second cover 70 that is on the −D side and is an end portion on the −W side is exposed through a recess portion 68 formed at an edge surface of the first cover 60 that is on the −W side. In other words, the recess portion 68 is provided closer to the first hinge 56 side than the recess portion 66 in the apparatus width direction. In other words, the recess portion 68 is provided at an end portion of the first cover 60 that is on the −W side. In other words, a distance L between the recess portion 68 and the recess portion 66 in the apparatus width direction is larger than half the distance L1 between the recess portion 66 and the first hinge 56 in the apparatus width direction ($L > 0.5 \times L1$). The distance between the recess portion 68 and the first hinge 56 in the apparatus width direction will be referred to as a distance L2. As shown in FIGS. 3 and 4, in a case where the second cover 70 is pulled to the front side (+D side) with a finger or the like hooked on a portion of the second cover 70 exposed through the recess portion 68, the second cover 70 is rotated around the shaft portion of the second hinge 72 and enters the open state. The recess portion 68 and a portion of the second cover 70 exposed through the recess portion 68 are an example of an operation portion of the second cover 70.

Figure 7:
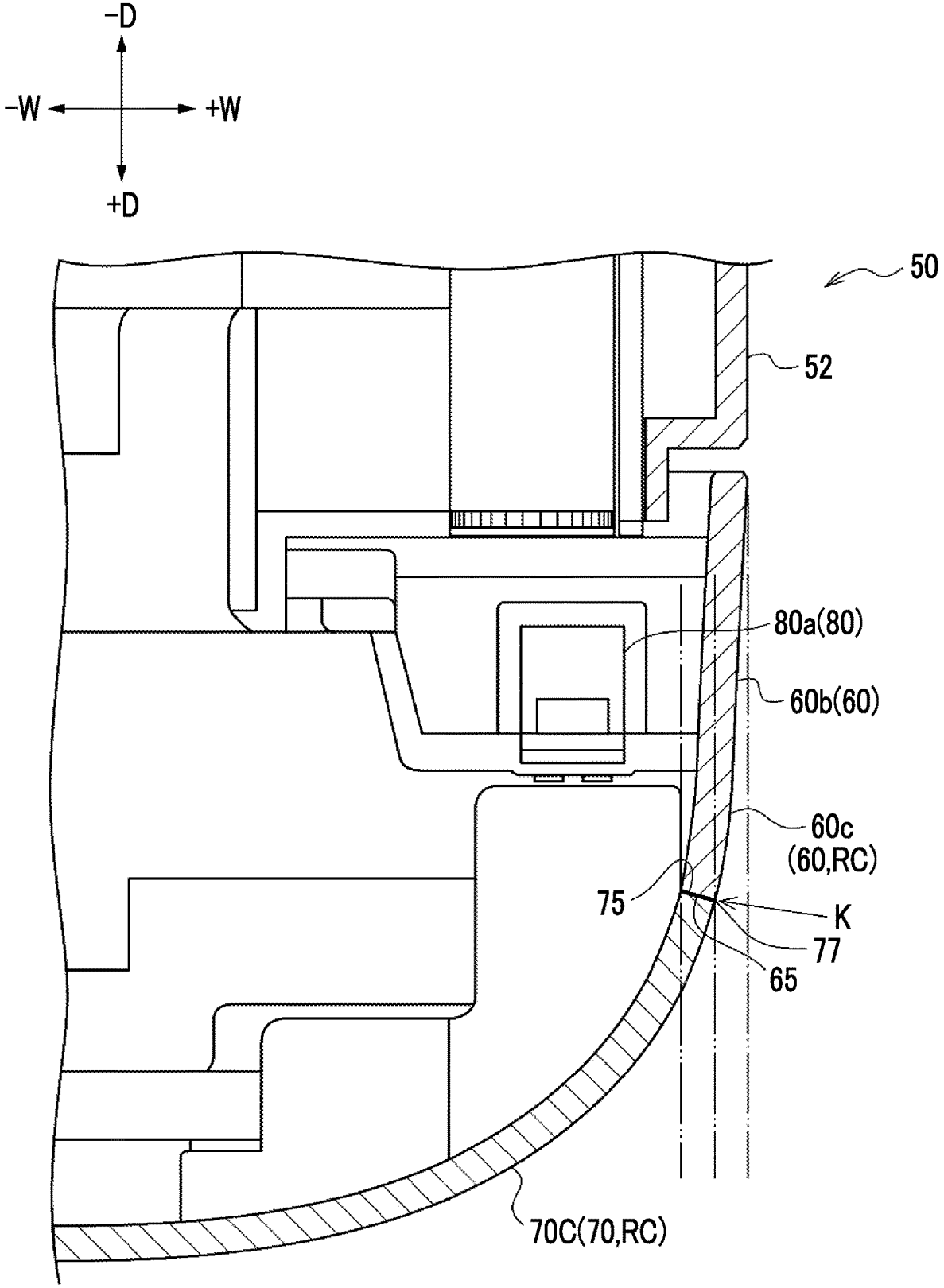
FIG. 7 is a cross-sectional view taken along line 8-8 of FIG. 1.

As shown in FIGS. 1 and 7, in a case where the second cover 70 is in the closed state, the front cover 70*a*, the side wall 70*b*, and the curved surface portion 70*c* of the second cover 70 are approximately flush with the front cover 60*a*, the side wall 60*b*, and the curved surface portion 60*c* of the first cover 60, respectively. That is, an outer surface of an end portion of the second cover 70 that is on the +W side is approximately flush with the first cover 60. As shown in FIG. 7, in the exemplary embodiment, in a case where the second cover 70 is in the closed state, at least a portion of an edge surface 75 of the second cover 70 and at least a portion of an edge surface 65 of the first cover 60 face each other at a boundary portion K between the first cover 60 and the second cover 70, which is on the +W side. In a case where the second cover 70 is in the closed state, an end portion 77 of the curved surface portion 70*c* of the second cover 70, which is on the +W side, is disposed closer to the −W side than the outermost surfaces of the side wall 60*b* and the curved surface portion 60*c* of the first cover 60 in the apparatus width direction. That is, in a case where the second cover 70 is in the closed state, the end portion 77 of the second cover 70 that is on the +W side is disposed closer to the −W side than the outermost surface of the first cover 60 that is on the +W side.

Specifically, a level difference between outer surfaces at a parting portion between the second cover 70 and the first cover 60 is 1 mm or less. In other words, a radius difference between the curved surface portion 70*c* of the second cover 70 and the curved surface portion 60*c* of the first cover 60 as seen in the apparatus vertical direction is 1 mm or less. In other words, the amount of misalignment between the curved surface portion 70*c* of the second cover 70 and the curved surface portion 60*c* of the first cover 60 as seen in the apparatus vertical direction is 1 mm or less. Note that, the outer surface of the end portion of the second cover 70 that is on the +W side may not be approximately flush with the first cover 60. That is, the level difference between the outer surfaces at the parting portion between the second cover 70 and the first cover 60 may exceed 1 mm.

In addition, the curved surface portion 70*c* of the second cover 70 and the curved surface portion 60*c* of the first cover 60 form a curved surface portion RC in the vicinity of an end portion of the housing main body 52 that is on the +W side. In addition, the boundary portion K between the second cover 70 and the first cover 60, which is on the +W side, is formed at the curved surface portion RC. The boundary portion K is a gap formed between the second cover 70 and the first cover 60 and has a width such that a finger cannot enter the gap deeply.

As shown in FIG. 4, two magnetic blocks 90*b* paired with the magnets 90*a* of the second binding unit 90 are disposed at a plate surface of the second cover 70 that faces the −D side in a case where the second cover 70 is in the closed state. In addition, a protruding portion 92*b* paired with the opening portion 92*a* of the second switch unit 92 is disposed at the plate surface of the second cover 70 that faces the −D side in a case where the second cover 70 is in the closed state. Details of the magnetic blocks 90*b* and the protruding portion 92*b* will be described later.

First Binding Unit

As shown in FIG. 5, the first binding unit 80 is configured to include the magnet 80*a* disposed at the housing main body 52 and the magnetic block 80*b* disposed at the first cover 60. In a case where the first cover 60 is in the closed state, the magnet 80*a* is in contact with the magnetic block 80*b* and adsorbs the magnetic block 80*b* with a magnetic force F1 to bind the first cover 60 to the housing main body 52. The magnetic force F1 is an example of a first binding force. The magnet 80*a* may not come into contact with the magnetic block 80*b* as long as the magnet 80*a* can adsorb the magnetic block 80*b* with the magnetic force F1 in a case where the first cover 60 is in the closed state. In a case where the first cover 60 in the closed state is pulled to the front side (+D side) by a force larger than the magnetic force F1 with a finger or the like hooked on the recess portion 66, the first cover 60 is rotated around a shaft of the first hinge 56 and enters the open state.

Second Binding Unit

As shown in FIG. 4, the second binding unit 90 is configured to include two magnets 90*a* disposed at the first cover 60 and two magnetic blocks 90*b* disposed at the second cover 70. In a case where the second cover 70 is in the closed state, the two magnets 90*a* are in contact with the respective magnetic blocks 90*b* which correspond to the magnets 90*a* respectively and adsorb the magnetic blocks 90*b* with a magnetic force F2 to bind the second cover 70 to the first cover 60. The magnetic force F2 is an example of a second binding force. The two magnets 90*a* may not come into contact with the magnetic blocks 90*b* respectively as long as the magnets 90*a* can adsorb the respective magnetic blocks 90*b* with the magnetic force F2 in a case where the second cover 70 is in the closed state. The magnetic force F2 of the second binding unit 90 is smaller than the magnetic force F1 of the first binding unit 80. In a case where the second cover 70 in the closed state is pulled to the front side (+D side) by a force larger than the magnetic force F2 with a finger or the like hooked on a portion of the second cover 70 exposed through the recess portion 68 of the first cover 60, the second cover 70 is rotated around a shaft of the second hinge 72 and enters the open state.

First Switch Unit

As shown in FIG. 5, the first switch unit 82 is configured to include the opening portion 82*a* disposed at the housing main body 52 and the protruding portion 82*b* disposed at the first cover 60. The opening portion 82*a* is disposed at an end portion of the front surface 54 of the housing main body 52 that is on the +W side. The protruding portion 82*b* is disposed at the first cover 60 to correspond to the opening portion 82*a*. The first switch unit 82 is connected to the control unit (not shown) of the image forming apparatus 20 and has a function of restoring or cutting off supply of power to the image forming unit 30 and the roller unit RU.

In a case where the first cover 60 is in the closed state, with the protruding portion 82*b* inserted into the opening portion 82*a*, the first switch unit 82 transmits a signal that indicates the first cover 60 is in the closed state to the control unit (not shown) so that power is supplied to the image forming unit 30 and the roller unit RU. In addition, in a case where the first cover 60 is in the open state, with the protruding portion 82*b* not inserted into the opening portion 82*a*, the first switch unit 82 transmits a signal that indicates the first cover 60 is in the open state to the control unit (not shown) so that supply of power to the image forming unit 30 and the roller unit RU is cut off. In a case where supply of power to the image forming unit 30 and the roller unit RU is cut off, the image forming unit 30 and the roller unit RU enter a state where maintenance can be performed.

Second Switch Unit

As shown in FIGS. 4 and 5, the second switch unit 92 is configured to include the opening portion 92*a* disposed at the housing main body 52 and the protruding portion 92*b* disposed at the second cover 70. The second switch unit 92 is connected to the control unit (not shown) of the image forming apparatus 20 and has a function of restoring or cutting off supply of power to the toner supply unit 35.

In a case where both of the first cover 60 and the second cover 70 are in the closed state, with the protruding portion 92*b* inserted into the opening portion 92*a*, the second switch unit 92 transmits a signal that indicates the second cover 70 is in the closed state to the control unit (not shown) so that power is supplied to the toner supply unit 35. With power supplied to the toner supply unit 35, the toners T of the cartridge units 22 can be supplied to the image formation units 32. In addition, in a case where the second cover 70 is in the open state, with the protruding portion 92*b* not inserted into the opening portion 92*a*, the second switch unit 92 transmits a signal that indicates the second cover 70 is in the open state to the control unit (not shown) so that supply of power to the toner supply unit 35 is cut off. In a case where supply of power to the toner supply unit 35 is cut off, the cartridge units 22 become replaceable with other cartridge units 22.

Others

As shown in FIG. 5, in a case where the first cover 60 is in the open state, the protruding portion 92*b* of the second cover 70 is in a state of being not inserted into the opening portion 92*a* of the housing main body 52 since the second cover 70 moves integrally with the first cover 60. Therefore, in a case where the first cover 60 is in the open state, supply of power to the image forming unit 30, the roller unit RU, and the toner supply unit 35 is cut off. Therefore, in a case where there is a change from a state where the first cover 60 is in the open state to a state where both of the first cover 60 and the second cover 70 are in the closed state, power supply to the image forming unit 30, the roller unit RU, and the toner supply unit 35 needs to be performed in order that the image forming apparatus 20 enters a state where printing can be performed. Meanwhile, in a case where the first cover 60 is in the closed state and the second cover 70 is in the open state, only power supply to the toner supply unit 35 is cut off and power is supplied to the image forming unit 30 and the roller unit RU. Therefore, in a case where there is a change from a state where only the second cover 70 is in the open state to a state where the second cover 70 is in the closed state, only power supply to the toner supply unit 35 needs to be performed in order that the image forming apparatus 20 enters a state where printing can be performed. Therefore, a time taken for the image forming apparatus 20 to enter a state where printing can be performed in a case where there is a change from a state where only the second cover 70 is in the open state to a state where the second cover 70 is in the closed state is shorter than a time taken for the image forming apparatus 20 to enter a state where printing can be performed in a case where there is a change from a state where the first cover 60 is in the open state to a state where the first cover 60 is in the closed state.

Operation and Effect

Next, the operation and effect of the present invention will be described. Note that, in a case where components or the like that are the same as components or the like of the image forming apparatus 20 of the exemplary embodiment are used for description of a comparative embodiment with respect to the exemplary embodiment, the description will be made without changing the reference numerals and the names of the components or the like.

In the housing 50 of the exemplary embodiment, the recess portion 68, which is the operation portion of the second cover 70, is provided closer to the first hinge 56 than the recess portion 66, which is the operation portion of the first cover 60, in the apparatus width direction. The housing 50 of the exemplary embodiment will be compared with a housing 150 as a first comparative embodiment, which will be described below.

Figure 8:
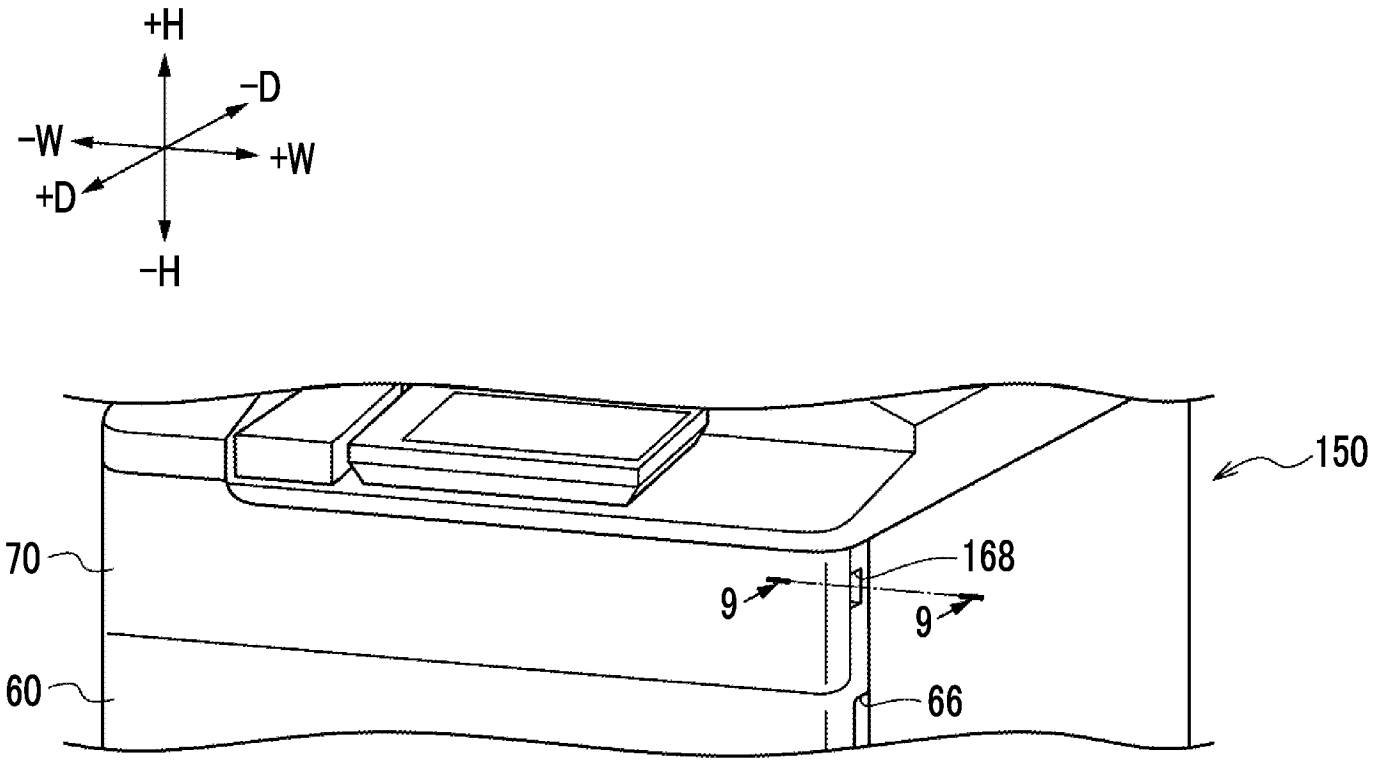
FIG. 8 is a perspective view showing a housing including a second cover of a comparative embodiment of the exemplary embodiment.

In the housing 150 of the first comparative embodiment, as shown in FIG. 8, a recess portion 168, through which a portion of the second cover 70 that is on the −D side is exposed, is formed at an edge surface of the first cover 60 that is on the +W side. That is, in the housing 150 of the first comparative embodiment, the recess portion 66 and the recess portion 168 are provided at the same position in the apparatus width direction. In addition, in the housing 150 of the first comparative embodiment, the recess portion 168 is provided closer to the +W side than the first hinge 56 in the apparatus width direction. The distance L2 between the recess portion 168 and the first hinge 56 in the apparatus width direction is equal to the distance between the recess portion 66 and the first hinge 56 and is the distance L1 (L2=L1). In a case where the second cover 70 in the first comparative embodiment is pulled to the front side (+D side) with a finger or the like hooked on a portion of the second cover 70 exposed through the recess portion 168, the second cover 70 is rotated around the shaft of the second hinge 72 and enters the open state. In addition, in the housing 150 of the first comparative embodiment, the magnetic force F2 of the second binding unit 90 is equivalent to the magnetic force F1 of the first binding unit 80 (F2=F1). Except for the above points, the housing 150 of the first comparative embodiment has the same configuration as the housing 50 of the exemplary embodiment.

In the first comparative embodiment, in a case where a state where both of the first cover 60 and the second cover 70 are in the closed state is to be changed to a state where only the second cover 70 is in the open state, the second cover 70 is pulled toward the front side (+D side) with a finger or the like hooked on a portion of the second cover 70 that is exposed through the recess portion 168. In this case, since the second cover 70 is provided on the first cover 60, a moment of F2×L2 that acts on the recess portion 168 so that the second cover 70 is opened is transmitted to the first binding unit 80 via the second cover 70 and the first cover 60 and acts on the first binding unit 80. In the first comparative embodiment, in a case where the second cover 70 is opened, a moment that acts in a direction the first cover 60 enters the open state and that has a magnitude of F1 ×L1 is transmitted to the first binding unit 80 and thus the first cover 60 may enter the open state since F2=F1 and L2=L1. That is, in the housing 150 of the first comparative embodiment, the first cover 60 may enter the open state due to an operation of causing the second cover 70 to enter the open state.

Meanwhile, in the housing 50 of the exemplary embodiment, the recess portion 68, which is the operation portion of the second cover 70, is provided closer to the first hinge 56 than the recess portion 66, which is the operation portion of the first cover 60, in the apparatus width direction as shown in FIGS. 3 and 5. Therefore, a force that pulls the second cover 70 to the +D side with a finger or the like hooked on a plate surface of the second cover 70 that is exposed through the recess portion 68 is transmitted to a portion of the first cover 60 that is closer to the first hinge 56 than the recess portion 66. Accordingly, in the exemplary embodiment, a moment that is transmitted to the first cover 60 due to an operation of causing the second cover 70 to enter the open state is small in comparison with the first comparative embodiment and thus the first cover 60 is less likely to enter the open state. Therefore, in the case of the housing 50 in a configuration in which the first cover 60 is supported by means of the first hinge 56, the first cover 60 is restrained from entering the open state due to an operation of causing the second cover 70 to enter the open state in comparison with the housing 150 of the first comparative embodiment. The effect as described above may also be achieved even in a case where the magnetic force F1 and the magnetic force F2 are equivalent to each other (F1=F2) in the housing 50 in the exemplary embodiment.

In addition, in the housing 50 of the exemplary embodiment, the distance between the recess portion 68 and the recess portion 66 in the apparatus width direction is larger than half the distance between the recess portion 66 and the first hinge 56 in the apparatus width direction. The shorter the distance between the operation portion of the second cover 70 and the operation portion of the first cover 60 in the apparatus width direction, the larger a force transmitted to the operation portion of the first cover 60 via the second cover 70 in a case where the second cover 70 is pulled so that the second cover 70 enters the open state. Therefore, in the case of the housing 50, the first cover 60 is restrained from entering the open state due to an operation of causing the second cover 70 to enter the open state in comparison with a configuration in which the distance between the recess portion 68 and the recess portion 66 is smaller than half the distance between the recess portion 66 and the first hinge 56 in the apparatus width direction.

In addition, in the housing 50 of the exemplary embodiment, the recess portion 68 is provided at the end portion of the first cover 60 that is on the same side as the first hinge 56 in the apparatus width direction. Therefore, in the case of the housing 50 in a configuration in which the first cover 60 is supported by means of the first hinge 56, the first cover 60 is restrained from entering the open state due to an operation of causing the second cover 70 to enter the open state in comparison with the housing 150 of the first comparative embodiment.

In addition, in the housing 50 of the exemplary embodiment, the magnetic force F2 of the second binding unit 90 is smaller than the magnetic force F1 of the first binding unit 80. Therefore, in the case of the housing 50 of the exemplary embodiment, it is possible to cause the second cover 70 to enter the open state by pulling the second cover 70 with a force smaller than a force required to cause the first cover 60 to enter the open state. Therefore, in the case of the housing 50 of the exemplary embodiment, the first cover 60 is restrained from entering the open state due to an operation of causing the second cover 70 to enter the open state in comparison with a configuration in which the magnetic force F2 of the second binding unit 90 is larger than the magnetic force F1 of the first binding unit 80. The effect as described above may also be achieved even in a case where the distance L1 and the distance L2 are equivalent to each other (L1=L2) in the housing 50 in the exemplary embodiment.

In addition, the housing 50 of the exemplary embodiment has a configuration in which the second cover 70 is supported by means of the second hinge 72 provided in the first cover 60. Therefore, in the case of a housing supposed to have such a configuration, the first cover 60 of the housing 50 of the exemplary embodiment is restrained from entering the open state due to an operation of causing the second cover 70 to enter the open state in comparison with the housing 150 of the first comparative embodiment. In addition, in the case of a housing supposed to have such a configuration, the first cover 60 of the housing 50 of the exemplary embodiment is restrained from entering the open state due to an operation of causing the second cover 70 to enter the open state in comparison with a configuration in which the magnetic force F2 of the second binding unit 90 is larger than the magnetic force F1 of the first binding unit 80.

In addition, the housing 50 of the exemplary embodiment has a configuration in which the shaft of the second hinge 72 extends in an intersection direction with respect to the shaft of the first hinge 56. Therefore, in the case of a housing supposed to have such a configuration, the first cover 60 of the housing 50 of the exemplary embodiment is restrained from entering the open state due to an operation of causing the second cover 70 to enter the open state in comparison with the housing 150 of the first comparative embodiment. In addition, in the case of a housing supposed to have such a configuration, the first cover 60 of the housing 50 of the exemplary embodiment is restrained from entering the open state due to an operation of causing the second cover 70 to enter the open state in comparison with a configuration in which the magnetic force F2 of the second binding unit 90 is larger than the magnetic force F1 of the first binding unit 80.

Figure 9:
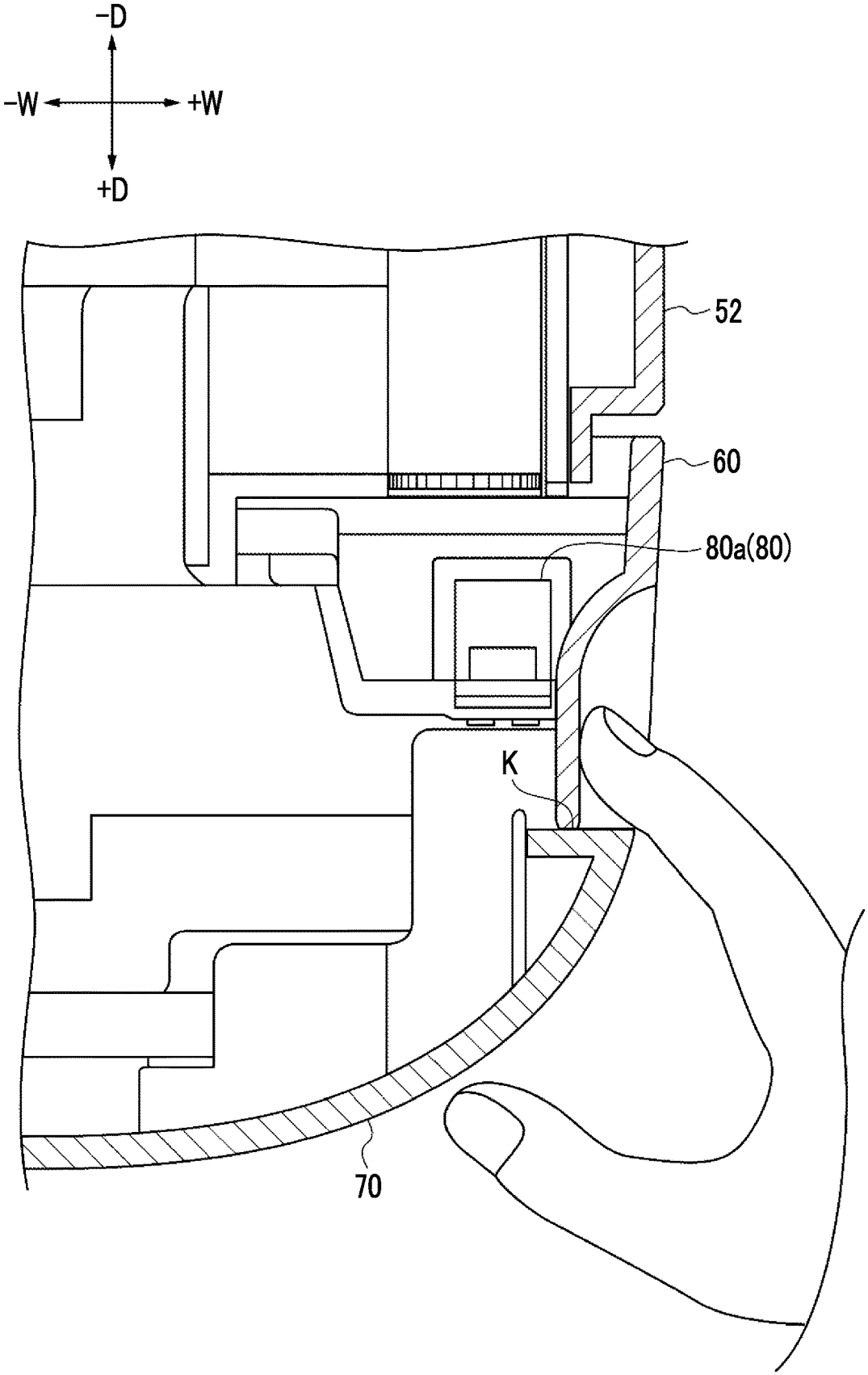
FIG. 9 is a cross-sectional view taken along the line 9-9 of FIG. 8.

In addition, in the housing 50 of the exemplary embodiment, the outer surface of the end portion of the second cover 70 that is on the +W side is approximately flush with the first cover 60 in a case where the second cover 70 is in the closed state. Therefore, in the housing 50 of the exemplary embodiment, a finger or the like is less likely to be caught in the end portion of the second cover 70 that is on the +W side. In a case where it is possible to hook a finger or the like on the end portion of the second cover 70 that is on the +W side as shown in FIG. 9, there is a probability that a force that pulls the second cover 70 and that results from an operation of hooking the finger or the like on the end portion is transmitted to the first cover 60 and causes the first cover 60 to enter the open state. Accordingly, in the case of the housing 50 of the exemplary embodiment, the first cover 60 is restrained from entering the open state unintentionally in comparison with a configuration in which it is possible to hook a finger or the like on the end portion of the second cover 70 that is on the +W side.

In addition, in the housing 50 of the exemplary embodiment, in a case where the second cover 70 is in the closed state, the end portion of the second cover 70 that is on the +W side is disposed closer to the −W side than the outermost surface of the first cover 60 that is on the +W side. Therefore, in the case of the housing 50 of the exemplary embodiment, a finger or the like is less likely to be caught in the end portion of the second cover 70 that is on the +W side in comparison with a configuration in which the end portion of the second cover 70 that is on the +W side protrudes toward the +W side further than the outermost surface of the first cover 60 that is on the +W side.

In addition, the housing 50 of the exemplary embodiment has a configuration in which the boundary portion between the second cover 70 and the first cover 60 that is on the +W side is formed at the curved surface portion RC. A case where an operator performs an operation of opening the second cover 70 while hooking a finger of the left hand of the operator on the recess portion 68 on the −W side with the right hand of the operator placed on a side surface of the housing main body 52 that is on the +W side will be assumed. In this case, since the boundary portion between the second cover 70 and the first cover 60 that is on the +W side is formed at the curved surface portion RC, in the case of the housing 50 of the exemplary embodiment, the finger or the like is less likely to be caught in the boundary portion between the second cover 70 and the first cover 60 that is on the +W side.

Meanwhile, a case where an operator performs an operation of opening the second cover 70 with the right hand of the operator placed on the side surface of the housing main body 52 that is on the +W side in a configuration in which the boundary portion between the second cover 70 and the first cover 60 that is on the +W side is formed at the side walls 60*b* and 70*b* will be assumed. In this case, in a configuration in which the boundary portion between the second cover 70 and the first cover 60 is formed at the side walls 60*b* and 70*b*, a finger or the like of the right hand placed on the side surface of the housing main body 52 that is on the +W side may be unintentionally caught in the boundary portion. In a case where the finger is caught in the boundary portion, there is a probability that a force that pulls the second cover 70 and that results from an operation of hooking the finger on the boundary portion is transmitted to the first cover 60 and causes the first cover 60 to enter the open state unintentionally. On the other hand, in the case of the housing 50 of the exemplary embodiment, since a finger or the like is less likely to be caught in the boundary portion between the second cover 70 and the first cover 60 that is on the +W side, a finger of the right hand placed on the side surface of the housing main body 52 that is on the +W side is restrained from causing the first cover 60 to enter the open state unintentionally.

In addition, the image forming apparatus 20 of the exemplary embodiment includes the housing 50. Therefore, in the case of the image forming apparatus 20 of the exemplary embodiment, the first cover 60 is restrained from entering the open state due to an operation of causing the second cover 70 to enter the open state in comparison with a configuration in which the housing 150 of the first comparative embodiment is provided. In addition, in the case of the image forming apparatus 20 of the exemplary embodiment, the first cover 60 is restrained from entering the open state due to an operation of causing the second cover 70 to enter the open state in comparison with a configuration in which a housing in which the magnetic force F2 of the second binding unit 90 is larger than the magnetic force F1 of the first binding unit 80 is provided.

In addition, the image forming apparatus 20 of the exemplary embodiment has a configuration in which the second cover 70 covers the cartridge units 22. Therefore, in the case of the image forming apparatus 20 of the exemplary embodiment, the first cover 60 is restrained from entering the open state due to an operation of causing the second cover 70 to enter the open state for replacement of the cartridge units 22 in comparison with a configuration in which the housing 150 of the first comparative embodiment is provided. In addition, in the case of the image forming apparatus 20 of the exemplary embodiment, the first cover 60 is restrained from entering the open state due to an operation of causing the second cover 70 to enter the open state for replacement of the cartridge units 22 in comparison with a configuration in which the magnetic force F2 of the second binding unit 90 is larger than the magnetic force F1 of the first binding unit 80.

Modification Example

Next, an image forming apparatus 220 including a housing 250, which is an example of a modification example of the image forming apparatus including the housing according to the exemplary embodiment of the present invention, will be described with reference to FIGS. 10 and 11. In addition, the modification example will be described focusing on a difference between the modification example and the exemplary embodiment. Note that, in a case where components or the like that are the same as components or the like of the image forming apparatus 20 of the exemplary embodiment are used for description of the modification example, the description will be made without changing the reference numerals and the names of the components or the like.

Image Forming Apparatus 220 and Housing 250

Figure 10:
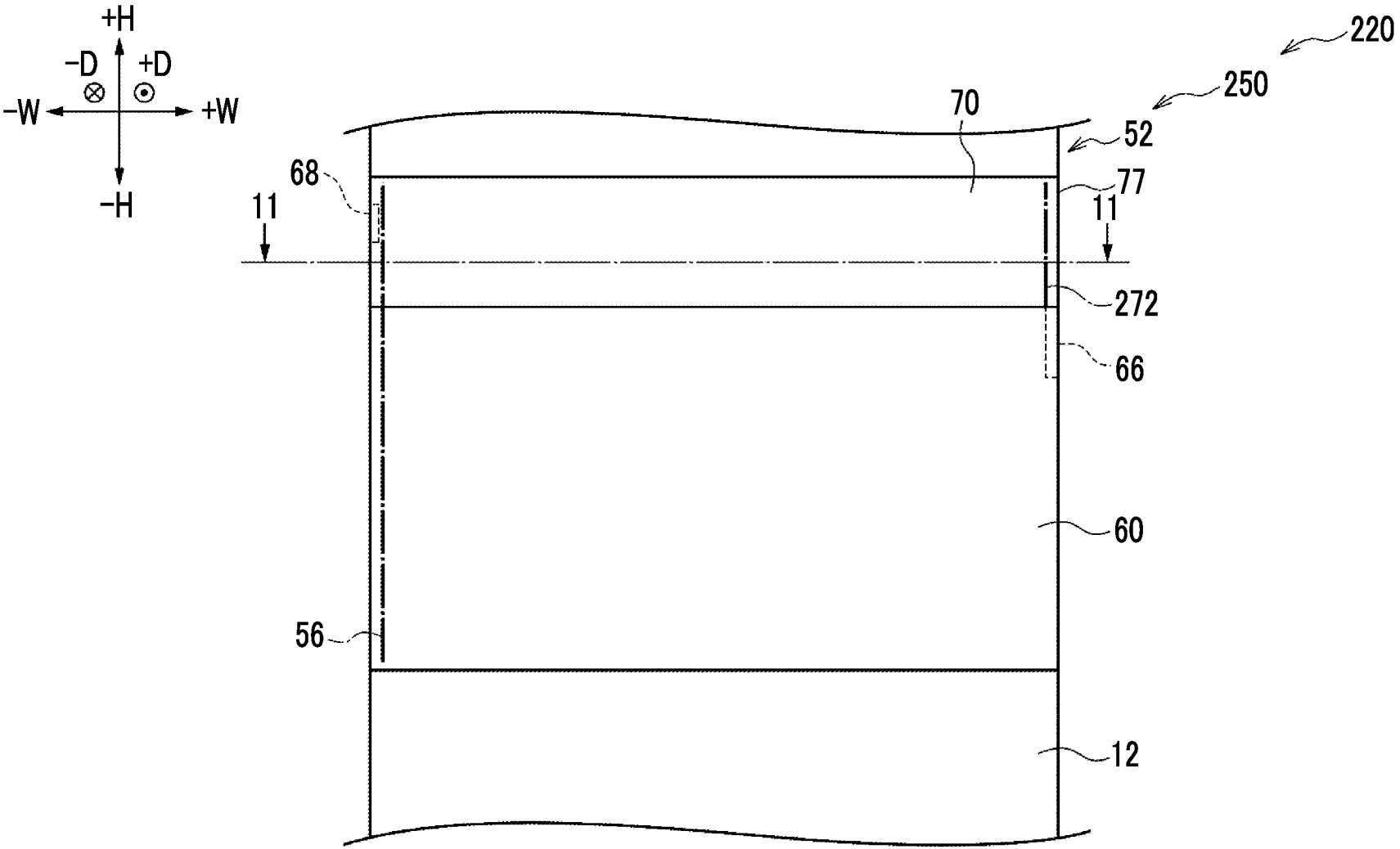
FIG. 10 is a front view showing a modification example of the image forming apparatus according to the exemplary embodiment.
Figure 11:
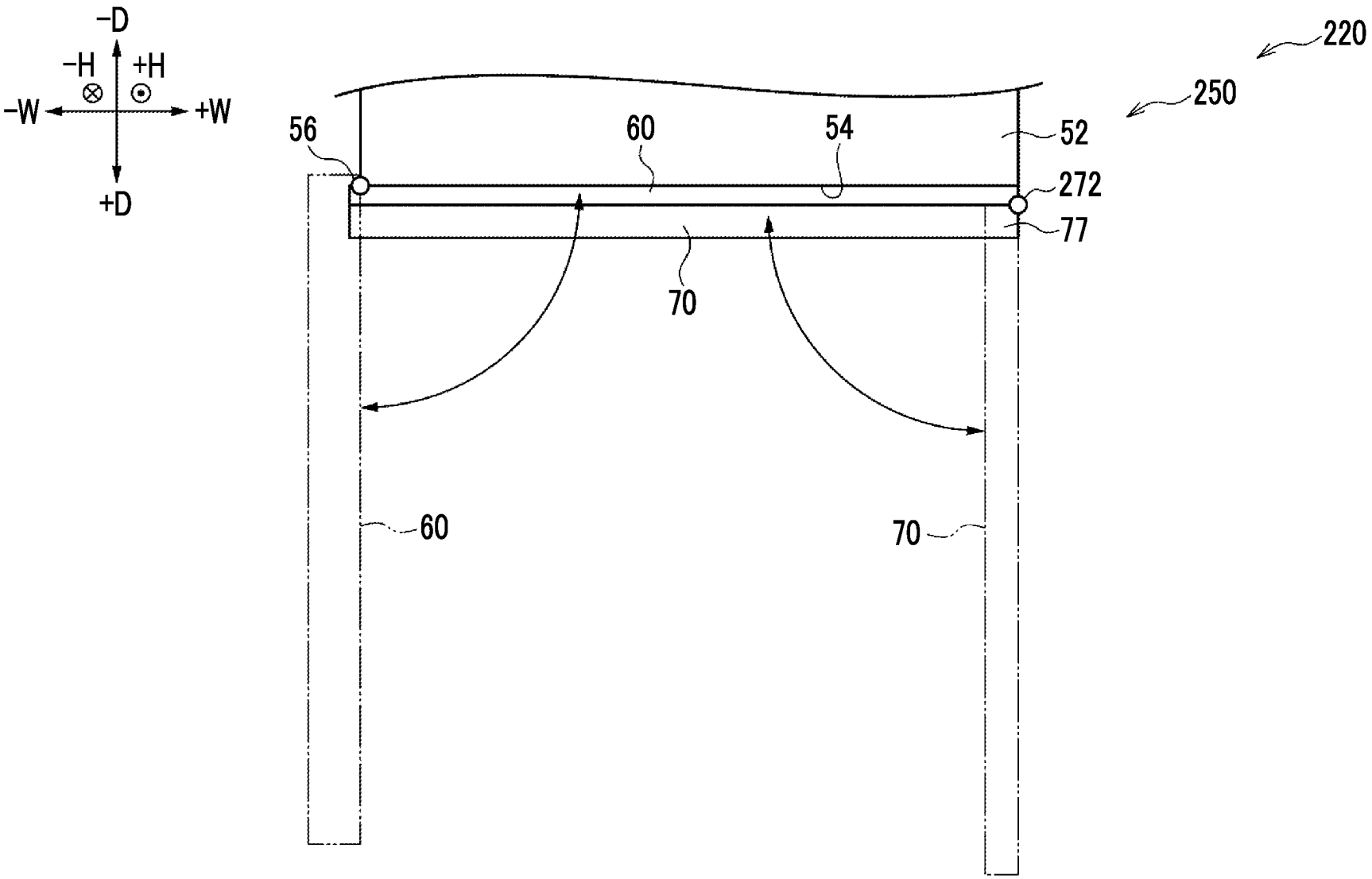
FIG. 11 is a cross-sectional view taken along the line 11-11 of FIG. 10.

As shown in FIG. 10, the housing 250 of the image forming apparatus 220 includes a second hinge 272 instead of the second hinge 72 of the housing 50.

The second hinge 272 is disposed at an end portion of the stepped portion 64 of the first cover 60 that is on the +W side such that a shaft portion of the second hinge 272 extends in the apparatus vertical direction and the second hinge 272 supports the end portion 77 of the second cover 70 that is on the +W side. That is, the second hinge 272 is provided at the end portion 77 of the second cover 70 that is close to the recess portion 66 of the first cover 60. In addition, the second cover 70 is supported by means of the second hinge 272 such that the stepped portion 64 of the first cover 60 can be opened and closed. In addition, a rotation axis of the second hinge 272 extends in the apparatus vertical direction. In addition, the second cover 70 is openably and closably supported by means of the second hinge 272, the second cover 70 swinging right as seen from the front surface 54 side of the housing main body 52 (refer to FIG. 11). That is, in the present exemplary embodiment, the second cover 70 that swings right is openably and closably supported by means of the second hinge 272 with respect to the first cover 60 that swings left.

Except for the above points, the image forming apparatus 250 has the same configuration as the image forming apparatus 20. That is, the first cover 60 includes the recess portion 68 constituting the operation portion of the second cover 70 at the edge surface on the −W side. That is, the recess portion 68 is provided closer to the first hinge 56 side than the recess portion 66 in the apparatus width direction.

Operation and Effect

Next, the operation and effect of the above-described modification example will be described.

In the housing 250, the second cover 70 is openably and closably supported by means of the second hinge 272 provided at the end portion 77 of the second cover 70 that is provided close to the recess portion 68 of the first cover 60. In addition, in the housing 250, the recess portion 68, which constitutes the operation portion of the second cover 70, is provided closer to the first hinge 56 than the recess portion 66 in the apparatus width direction. Accordingly, the second cover 70 swings right unlike the first cover 60 while the first cover 60 swings left as seen from the front surface 54 of the housing main body 52 (refer to FIG. 11). Therefore, in the case of the housing 250, the first cover is restrained from entering the open state due to an operation of causing the second cover to enter the open state in comparison with a configuration in which the second cover 70 and the first cover 60 swing in the same direction.

Note that, in the modification example, an example in which the second cover 70 has the same width as the first cover 60 has been described. However, the present invention is not limited to such a configuration. For example, the width of the second cover 70 may be smaller than the width of the first cover 60. In this case, the second hinge 272 may be disposed closer to the first hinge 56 than the recess portion 66. In addition, in this case, the operation portion of the second cover 70 may be disposed closer to the recess portion 66 than the first hinge 56.

Although a specific exemplary embodiment has been described in detail as above, the present invention is not limited to the exemplary embodiment and various modifications, changes, improvements can be made without departing from the technical scope of the present invention.

For example, the purpose of use of the housing according to the exemplary embodiment of the present invention is not limited to an image forming apparatus and the housing may be applied to home appliances such as refrigerators and freezers, various production apparatuses, various types of equipment, a test and inspection apparatus, and the like.

In addition, in the housing according to the exemplary embodiment of the present invention, the operation portion of the second cover may be provided at the same position as the operation portion of the first cover in a direction orthogonal to an axis of the first rotation portion in a case where the second binding force of the second binding unit is smaller than the first binding force of the first binding unit.

In addition, in the exemplary embodiment, a configuration in which the second cover 70 covers the stepped portion 64 of the first cover 60 and the outer surface of the end portion of the second cover 70 that is on the +W side is approximately flush with the first cover 60 in the closed state has been described. However, the first cover according to the exemplary embodiment of the present invention may be configured not to cover the cartridge units, that is, the first cover may not have a configuration corresponding to the stepped portion 64 of the exemplary embodiment. In addition, the second cover according to the exemplary embodiment of the present invention may have a configuration in which the outer surface of the end portion on the +W side is approximately flush with the housing main body in the closed state.

In addition, in the exemplary embodiment, the first hinge 56 and the recess portion 68 are provided on the −W side and the recess portion 66 is provided on the +W side. However, the housing according to the exemplary embodiment of the present invention may have a configuration in which the first rotation portion and the operation portion of the second cover are provided on the +W side and the operation portion of the first cover is provided on the −W side.

In addition, in the exemplary embodiment, the cartridge units 22 are accommodated in a space above the image forming unit 30 in the housing 50. However, the cartridge units according to the exemplary embodiment of the present invention may be accommodated in a space below the image forming unit in the housing. The first cover and the second cover according to the exemplary embodiment of the present invention in this case are vertically symmetrical with respect to the first cover 60 and the second cover 70 of the exemplary embodiment.

In addition, the image forming apparatus according to the exemplary embodiment of the present invention may have a configuration in which the cartridge units and the image forming apparatus are arranged in the apparatus width direction. The first rotation portion according to the exemplary embodiment of the present invention in this case has a configuration in which the shaft portion extends in the apparatus width direction.

In addition, in the exemplary embodiment, the shaft of the second hinge 72 extends in the intersection direction with respect to the shaft of the first hinge 56. However, the shaft of the second rotation portion according to the exemplary embodiment of the present invention may extend to be parallel with the shaft of the first rotation portion.

In addition, the first binding unit and the second binding unit according to the exemplary embodiment of the present invention may be configured to include no magnetic block and no magnet and may be configured to bind the first cover or the second cover with a recess portion and a projection portion fitting to each other, the recess portion and the projection portion being paired with each other.

In addition, in the exemplary embodiment, the second cover 70 is openably and closably supported by the first cover 60 by means of the second hinge 72. However, the second cover according to the exemplary embodiment of the present invention may have a configuration in which the second cover can be opened and closed by being slid with respect to the first cover in an intersection direction that is parallel to a surface of the housing main body and intersects the shaft of the first rotation portion.

In addition, the housing 50 of the exemplary embodiment has a configuration in which the first cover 60 is supported by means of the first hinge 56 that is provided at the side wall of the housing main body 52 that is on the −W side. However, the housing according to the exemplary embodiment of the present invention is not limited to the housing 50 of the exemplary embodiment as long as the first rotation portion is provided at a portion on one side in a direction along one surface of the housing main body with respect to the opening in the one surface of the housing main body. For example, the housing according to the exemplary embodiment may have a configuration in which the opening of the housing main body is provided only on one side with respect to the center line of a front surface of the housing main body in the apparatus width direction and the first rotation portion is provided at one edge of the opening in the apparatus width direction.

In addition, regarding the first cover 60 of the exemplary embodiment, the window portions 62 are formed in the stepped portion 64 covered by the second cover 70. However, the first cover according to the exemplary embodiment of the present invention may have a configuration in which no window portion is formed at a portion covered by the second cover and a button, an interface, or the like is formed at the portion.

In addition, in the exemplary embodiment, the recess portion 66 is an example of the operation portion of the first cover 60. However, the operation portion of the first cover according to the exemplary embodiment of the present invention is not particularly limited as long as it is possible to hook a finger or the like on the operation portion and the operation portion may be a portion of the first cover that is exposed through a recess portion formed in the housing at a boundary portion between the housing and the first cover. In addition, the operation portion of the first cover according to the exemplary embodiment of the present invention may be a single projection portion or a plurality of projection portions formed on the first cover and may be a member such as a handle or the like provided on the first cover.

In addition, in the exemplary embodiment, the recess portion 68 and a portion of the second cover 70 exposed through the recess portion 68 are an example of the operation portion of the second cover 70. However, the operation portion of the second cover according to the exemplary embodiment of the present invention is not particularly limited as long as it is possible to hook a finger or the like on the operation portion and the operation portion may be a recess portion formed in the second cover. Further, the operation portion of the second cover according to the exemplary embodiment of the invention may be a single or a plurality of projection portions formed on the second cover, or may be a member such as a handle provided on the second cover. In particular, in a case where the operation portion of the second cover 70 is a projection portion or a member such as a handle, the operation portion may protrude toward the −W side further than the side wall 70*d* on the −W side. That is, the operation portion of the second cover 70 may be disposed closer to the −W side than the first hinge 56. A housing having a configuration in which the operation portion of the second cover 70 is provided closer to the −W side than the first hinge 56 has the same effect as the housing 50 having a configuration in which the operation portion of the second cover 70 is provided at the same position as the first hinge 56 in the apparatus width direction.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A housing comprising:

a housing main body that has an opening in one surface;

a first cover that is openably and closably supported by the housing main body by means of a first rotation portion, that covers at least a portion of the opening, and that is provided with an operation portion that causes the first cover in a closed state to enter an open state, the first rotation portion being provided on a portion of the one surface that is on one side with respect to the opening in one direction; and a second cover that is openably and closably supported by the first cover and of which a second operation portion that causes the second cover in a closed state to enter an open state is provided at a position that is separated from the operation portion of the first cover by at least half a distance between the operation portion of the first cover and the first rotation portion in the one direction while being on the first rotation portion side.

2. The housing according to claim 1, wherein a rotation axis of the first rotation portion extends in a direction intersecting the one direction, and the second cover is opened and closed while rotating around a rotation axis extending in the one direction.

3. The housing according to claim 2, wherein the second cover and the first cover or the housing main body form a curved surface portion at an end portion on the other side in the one direction in a case where the second cover is in the closed state, a boundary portion between the second cover and the first cover or the housing main body that is on the other side is formed at the curved surface portion, and in a case where the second cover is in the closed state, an end portion of the second cover that is on the other side is disposed closer to the one side in the one direction than an outermost surface of the first cover that is on the other side or an outermost surface of the housing main body that is on the other side.

4. The housing according to claim 1, wherein the second cover and the first cover or the housing main body form a curved surface portion at an end portion on the other side in the one direction in a case where the second cover is in the closed state, a boundary portion between the second cover and the first cover or the housing main body that is on the other side is formed at the curved surface portion, and in a case where the second cover is in the closed state, an end portion of the second cover that is on the other side is disposed closer to the one side in the one direction than an outermost surface of the first cover that is on the other side or an outermost surface of the housing main body that is on the other side.

5. An image forming apparatus comprising:

the housing according to claim 1;

a cartridge unit that is replaceably accommodated in the housing in a state where a portion of the cartridge unit is exposed through the one surface and that contains a coloring material; and an image forming unit that is accommodated in the housing in a state where a portion of the image forming unit is exposed through the one surface and that forms an image on a recording medium by using the coloring material, wherein the first cover covers the image forming unit, and the second cover covers the cartridge unit.

6. A housing comprising:

a housing main body that has an opening in one surface;

a first cover that is openably and closably supported by the housing main body by means of a first rotation portion and that covers at least a portion of the opening, the first rotation portion being provided on a portion of the one surface that is on one side with respect to the opening in one direction; and a second cover that is openably and closably supported by the first cover and of which an operation portion that causes the second cover in a closed state to enter an open state is provided at the same position as the first rotation portion in the one direction or closer to the one side than the first rotation portion in the one direction.

7. The housing according to claim 6, wherein a rotation axis of the first rotation portion extends in a direction intersecting the one direction, and the second cover is opened and closed while rotating around a rotation axis extending in the one direction.

8. The housing according to claim 7, wherein the second cover and the first cover or the housing main body form a curved surface portion at an end portion on the other side in the one direction in a case where the second cover is in the closed state, a boundary portion between the second cover and the first cover or the housing main body that is on the other side is formed at the curved surface portion, and in a case where the second cover is in the closed state, an end portion of the second cover that is on the other side is disposed closer to the one side in the one direction than an outermost surface of the first cover that is on the other side or an outermost surface of the housing main body that is on the other side.

9. The housing according to claim 6, wherein the second cover and the first cover or the housing main body form a curved surface portion at an end portion on the other side in the one direction in a case where the second cover is in the closed state, a boundary portion between the second cover and the first cover or the housing main body that is on the other side is formed at the curved surface portion, and in a case where the second cover is in the closed state, an end portion of the second cover that is on the other side is disposed closer to the one side in the one direction than an outermost surface of the first cover that is on the other side or an outermost surface of the housing main body that is on the other side.

10. A housing comprising:

a housing main body that has an opening in one surface;

a first cover that is openably and closably supported by the housing main body by means of a first rotation portion and that covers at least a portion of the opening, the first rotation portion being provided on a portion of the one surface that is on one side with respect to the opening in one direction;

a first binding unit that binds the first cover in a closed state to the housing main body with a first binding force;

a second cover that is openably and closably supported by the first cover; and a second binding unit that binds the second cover in a closed state to the first cover with a second binding force smaller than the first binding force.

11. The housing according to claim 10, wherein a rotation axis of the first rotation portion extends in a direction intersecting the one direction, and the second cover is opened and closed while rotating around a rotation axis extending in the one direction.

12. The housing according to claim 11, wherein the second cover and the first cover or the housing main body form a curved surface portion at an end portion on the other side in the one direction in a case where the second cover is in the closed state, a boundary portion between the second cover and the first cover or the housing main body that is on the other side is formed at the curved surface portion, and in a case where the second cover is in the closed state, an end portion of the second cover that is on the other side is disposed closer to the one side in the one direction than an outermost surface of the first cover that is on the other side or an outermost surface of the housing main body that is on the other side.

13. The housing according to claim 10, wherein the second cover and the first cover or the housing main body form a curved surface portion at an end portion on the other side in the one direction in a case where the second cover is in the closed state, a boundary portion between the second cover and the first cover or the housing main body that is on the other side is formed at the curved surface portion, and in a case where the second cover is in the closed state, an end portion of the second cover that is on the other side is disposed closer to the one side in the one direction than an outermost surface of the first cover that is on the other side or an outermost surface of the housing main body that is on the other side.

* * * * *